US005432487A

United States Patent [19]

Dydyk

[11] Patent Number: 5,432,487

[45] Date of Patent: Jul. 11, 1995

[54] MMIC DIFFERENTIAL PHASE SHIFTER

[75] Inventor: Michael Dydyk, Scottsdale, Ariz.

[73] Assignee: Motorola, Inc., Schaumburg, Ill.

[21] Appl. No.: 219,187

[22] Filed: Mar. 28, 1994

[51] Int. Cl.[6] ..... H01P 1/18; H01P 3/08

[52] U.S. Cl. ..... 333/161; 333/246

[58] Field of Search ..... 333/140, 138, 156, 161, 333/246

[56] References Cited

U.S. PATENT DOCUMENTS

| | | | |
|---|---|---|---|
| 3,517,348 | 6/1970 | Frost | 333/161 |
| 3,805,198 | 4/1974 | Gewartowski et al. | 333/204 |
| 4,070,639 | 1/1978 | Nemit et al. | 333/161 |
| 4,195,271 | 3/1980 | Schiek et al. | 333/161 |
| 4,371,853 | 2/1983 | Makimoto et al. | 333/204 |
| 4,885,562 | 12/1989 | Ouvrard et al. | 333/140 X |
| 4,901,272 | 2/1990 | Eto | 364/857 |
| 5,063,365 | 11/1991 | Cappucci | 333/161 X |
| 5,126,704 | 6/1992 | Dittmer et al. | 333/161 X |

OTHER PUBLICATIONS

An article entitled "Accurate Design of Microstrip Directional Couplers with Capacitive Compensation" by Michael Dydyk, 1990 MTT Symposium Digest, May 1990, pp. 581–584.

An article entitled "A New Class of Broad-Band Microwave 90-Degree Phase Shifters" by B. M. Schiffman, IRE Transactions on Microwave Theory and Techniques, Apr. 1958, pp. 232–237.

An article entitled "Broadband Matching of Microstrip Differential Phase Shifters" by B. Schiek et al., 1976 European Microwave Conference Proceedings, pp. 647–651.

*Primary Examiner*—Seungsook Ham

*Attorney, Agent, or Firm*—Jeffrey D. Nehr

[57] ABSTRACT

A microwave monolithic integrated circuit (MMIC) differential Schiffman phase shifter includes an input microstrip for receiving an input signal. First and second parallel microstrips produce a phase shifted signal from the input signal. The first microstrip is coupled at a first end to the input microstrip and at a second end to an end microstrip. The second microstrip is coupled at a first end to the end microstrip. An output microstrip is coupled to the second microstrip at a second end of the second microstrip and the input microstrip and the output microstrip are capacitively coupled. The output microstrip produces an output signal from the phase shifted signal.

9 Claims, 2 Drawing Sheets

FIG. 4-1
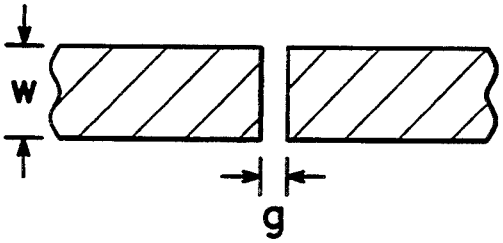
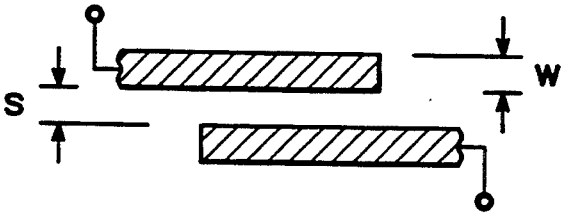
FIG. 4-2
FIG. 4-3
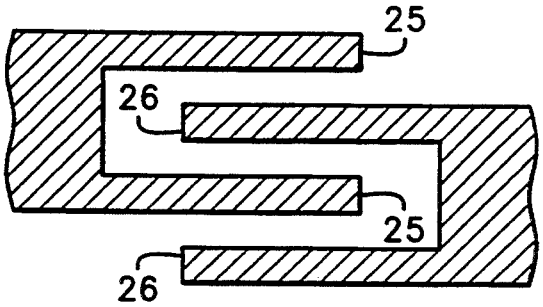
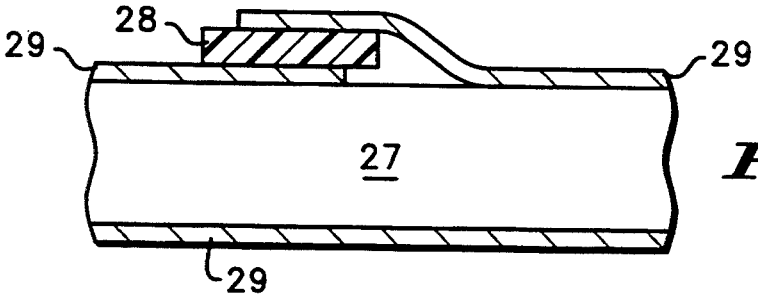
FIG. 4-4
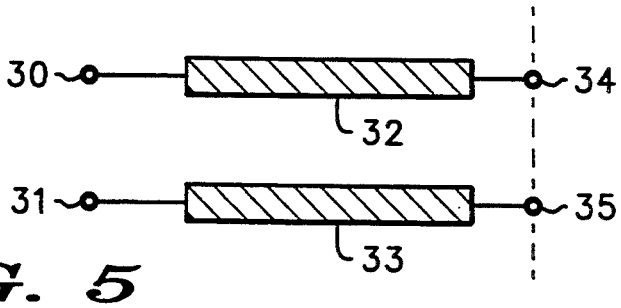
FIG. 5
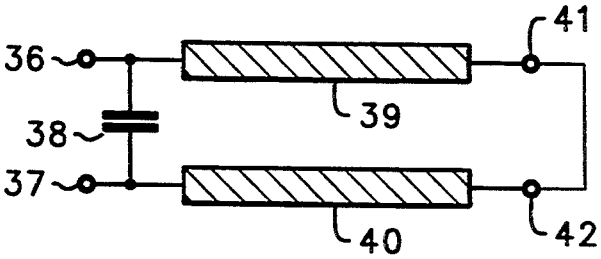

MMIC DIFFERENTIAL PHASE SHIFTER

FIELD OF THE INVENTION

This invention relates in general to phase shifting in microwave circuits and in particular to differential phase shifter apparatus.

BACKGROUND OF THE INVENTION

One of the basic components in microwave circuits is the differential phase shifter, most frequently used in the design of 45 degree, 90 degree, and 180 degree phase shifters. Differential phase shifters are useful in phased array antennas, distribution networks, balanced amplifiers, two-diode image rejection mixers, two-diode pseudo-image enhancement mixers and other circuit functions.

Differential phase shifters can be conveniently constructed 5 using parallel-coupled transmission lines of equal length operating in the transverse electromagnetic mode (TEM mode), connected at one end, as first described by B. M. Schiffman in the paper entitled "A New Class of Broadband Microwave 90 Degree Phase Shifters," IRE Transactions MTT, Apr., 1958, pages 232–237, herein incorporated by reference. The unconnected ends of the transmission lines serve as the input and output of a two-terminal-pair network.

Realization of such phase shifters in stripline and coaxial transmission line implementations has yielded excellent wideband performance, including high return loss, low insertion loss, and small phase shift deviation versus frequency. Attempts to make similar Schiffman phase shifters in microstrip transmission lines has typically resulted in poor performance. The primary reason for this appears to occur as a result of the difference in phase velocity between odd and even modes in a coupled microstrip transmission line.

One method of compensating for poor performance in microstrip Schiffman phase shifters is to use stepped coupled line structure as described in "Broadband Matching of Microstrip Differential Phase Shifters" by B. Schiek, J. Kohler, and W. Schilz, 1976 European Microwave Conference Proceedings, pages 647–651. In the stepped coupled line structure approach, the coupled region is divided into two sections of equal length with different even and odd mode characteristic impedances.

While substantially improved results can be obtained with the stepped coupled line structure approach, disadvantages include the following:

a) The electrical length of each section is not an arithmetic mean of the even and odd mode microstrip parameters; and b) The introduction o f step discontinuities in realizing different coupled sections degrades performance.

Thus, what is needed is a Schiffman differential phase shifter suitable for MMIC implementation that provides ideal performance over wide bandwidth.

BRIEF DESCRIPTION OF THE DRAWINGS

In FIGS. 4-1 to 4-4, there are shown four alternative embodiments of the compensation capacitor which can be used with the MMIC differential phase shifter of FIG. 1; and In FIG. 5,,there are shown the even and odd mode equivalent circuits for the MMIC differential phase shifter with compensation shown in FIG. 3.

DETAILED DESCRIPTION OF THE PREFERRED EMBODIMENT

Figure 1:
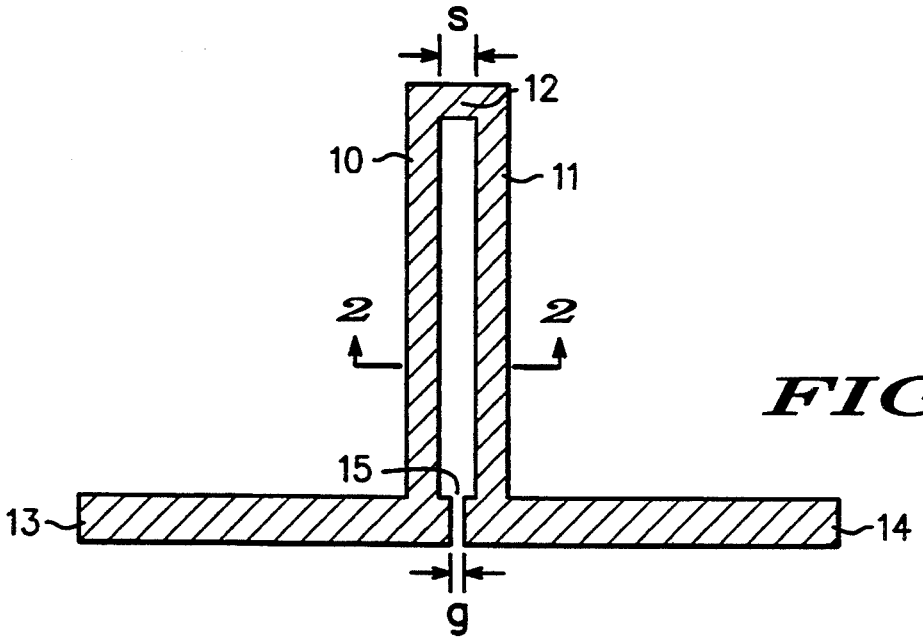
In FIG. 1, there is shown a diagram of a MMIC differential phase shifter in accordance with a preferred embodiment of the invention.

In FIG. 1, there is shown a diagram of a MMIC differential phase shifter of the Schiffman type in accordance with a preferred embodiment of the invention. An input microstrip 13 is coupled to a first end of a substantially linear section of microstrip 10. Microstrip 10 can be oriented substantially perpendicular to input microstrip 13 in an "L" configuration, with microstrip 10 and microstrip 13 in the same plane.

Microstrip 10 is coupled at a second end through end microstrip 12 of length s to a first end of a second substantially linear section of microstrip 11. Microstrip 10 and microstrip 11 are substantially parallel sections of microstrip line separated by a substantially uniform gap. An output microstrip 14 is coupled to a second end of microstrip 11. Output microstrip 14 can be oriented substantially perpendicular to microstrip 11, in an "L" configuration with microstrip 11, resulting in a straight alignment of output microstrip 14 with input microstrip 13, where output microstrip 14 is separated by a distance g from input microstrip line 13. The lengths of microstrip lines 10 and 11 (to the center of input microstrip 13 and output microstrip 14, respectively) are equal to each other and equal in length to one-fourth the wavelength of the operating center frequency of interest. Thus, the orientation of the microstrip lines is essentially two "L" shapes connected "back-to-back", with the top of the back-to-back "Ls" coupled by end microstrip 12, and the bottom of the back-to-back "Ls" separated by a gap 15 of width g, resulting in capacitive coupling between input microstrip 13 and output microstrip 14. (Alternatively, the microstrip 10 and 11 can be seen to form the projections of a narrow "U" shape, with the base of the "U" formed by end microstrip 12.)

In FIG. 1, the two parallel coupled transmission lines, i.e. microstrip lines 10 and 11, are characterized in terms of the even and odd mode characteristic impedances designated $Z_{oe}$ and $Z_{oo}$ and phase constants $\theta_e$ and $\theta_o$, respectively, where $Z_{oe}$ is the characteristic impedance of one line to ground when equal in-phase currents flow in both lines; $Z_{oo}$ is the characteristic impedance of one line to ground when equal out-of-phase currents flow in both lines; $\theta_e$ is the electrical length of one line when equal in-phase currents flow in both lines of length I and phase constant $\beta_e$ and is equal to $\beta_e{}^*$I; and $\theta_o$ is the electrical length of one line when equal out-of-phase currents flow in both lines of length I and phase constant $\beta_o$ and is equal to $\beta_o{}^*$I. These parameters are dependent on the relative dielectric constant and height of the substrate below the microstrip lines 10 and 11 and the input and output microstrip lines (13 and 14) and the width, separation, and thickness of each conductor line.

In function, input microstrip 13 receives an input signal. Microstrips 10 and 11, coupled through end microstrip 12, produce a phase shifted signal from the input signal. Output microstrip 14 produces an output signal from the phase shifted signal. The capacitive coupling between input microstrip 13 and output microstrip 14 produces ideal differential Schiffman phase shifter performance.

Figure 2:
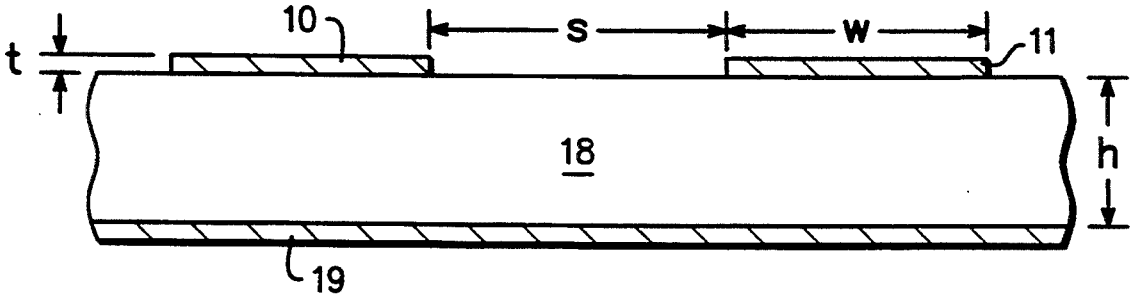
In FIG. 2, there is shown a cross-sectional view of the parallel coupled conductors in the MMIC differential phase shifter of FIG. 1 , with capacitive compensation.

In FIG. 2, there is shown a cross-sectional view of the parallel coupled conductors, i.e. representing microstrip lines 10 and 11 in the MMIC differential phase shifter of FIG. 1 along dashed line 2 of FIG. 1. Microstrip lines 10 and 11, each of width w and of cross-sectional thickness t, are oriented in a parallel fashion and spaced a distance s apart on a first surface of a dielectric substrate 18 (with dielectric constant $E_R$ of height h). Ground plane 19 is positioned immediately adjacent to a second surface of dielectric substrate 18 opposite the first surface, spaced from microstrip lines 10 and 11 by dielectric substrate 18.

Figure 3:
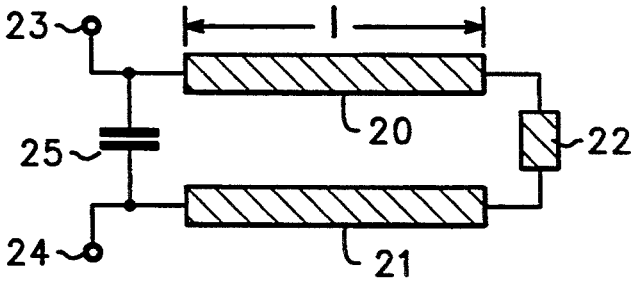
In FIG. 3, there is shown the equivalent circuit for the MMIC differential phase shifter shown in FIG. 1.

FIG. 3 illustrates the equivalent circuit for the MMIC differential phase shifter shown in FIG. 1. The analogous structures between FIGS. 3 and 1 are as follows: transmission lines 28 and 21 (each of length I) in FIG. 3 are analogous to microstrip lines 10 and 11 in FIG. 1; end coupling 22 in FIG. 3 is analogous to end microstrip 12 in FIG. 1; capacitor 25 in FIG. 3 is analogous to gap 15 in FIG. 1; and, input 23 and output 24 in FIG. 3 are analogous to input microstrip 13 and output microstrip 14 in FIG. 1.

The capacitor 25 is a series capacitor that can be implemented in a variety of forms. FIG. 4 shows four possible implementations, including FIG. 4-1, illustrating a top view of an end-coupled capacitor, where the microstrip lines are adjacent in an end-to-end fashion; FIG. 4-2, illustrating a top view of a edge-coupled capacitor, where the microstrip lines are adjacent in an edge-to-edge fashion; FIG. 4-3, illustrating an interdigitated capacitor, where microstrip fingers 25 from a first microstrip are spaced evenly in an alternating fashion with microstrip fingers 26 from a second microstrip; and FIG. 4-4, illustrating a metal-insulator-metal capacitor, where insulator 28 is "sandwiched" between conductors 29 on substrate :27. Proper combination of series capacitance 15 and the parallel coupled transmission line 20 and 21 characteristic impedances and lengths in the FIG. 3 equivalent circuit provide ideal microstrip Schiffman phase shifter performance in the microstrip phase shifter of FIG. 1.

The relationship between the various parameters governing the functional behavior of the ideal microstrip Schiffman phase shifter can be discerned from the illustration in FIG. 5. FIG. 5 results from application of symmetry analysis to FIG. 3, and shows the even and odd mode equivalent circuit of a microstrip Schiffman phase shifter with compensation (i.e., capacitive correction). Equivalency principles can be used as first proposed by Dydyk in "Accurate Design of Microstrip Directional Couplers with Capacitive Compensation," MTT Symposium Digest, May 1990, pages 581–584, herein incorporated by reference. The even mode equivalent circuit comprises connections 30 and 31, that are connected through transmission line portions 32 and 33, respectively, to connections 34 and 35. In the even mode analysis, connections 34 and 35 are electrically open connections. The odd mode equivalent circuit comprises connections 36 and 37, that are connected through transmission line portions 39 and 40, respectively, to connections 41 and 42. In the odd mode analysis, connections 41 and 42 are electrically shorted connections. Also in the odd mode, capacitor 38, of capacitance 2C, is coupled across the connections 36 and 37.

In FIG. 5, the respective input admittances to the circuits in the even and odd modes ($Y_{ine}$ and $Y_{ino}$, respectively) are given by:

$$Y_{ine}=j * Y_{oe}* \tan \theta_e \qquad \text{Equation 1}$$

$$Y_{ino}=j* [2* \omega* C-Y_{ooa}* \cot \theta_o] \qquad \text{Equation 2}$$

$$2* \omega* C-Y_{ooa}* \cot \theta_o=-Y_{ooi}* \cot \theta_e \qquad \text{Equation 3}$$

where $\omega$ is the operating frequency, $Y_{oe}$ is the characteristic even mode admittance, $Y_{ooa}$ and $Y_{ooi}$ represent the actual and ideal characteristic admittances, respectively, and equation 3 equates the input admittances of the actual and ideal odd mode circuit representations. Note that the electrical length of the ideal odd mode circuit representation has been made equal to the even mode case. Furthermore, to complete the equivalency, it is necessary to take a derivative of Equation 3 with respect to frequency and evaluate the result at a center frequency $\omega_o$, leading to the following relation:

$$Y_{ooi}=2* \omega* C/\pi+Y_{ooa}(E_{effo}/E_{effe})^{\frac{1}{2}} \qquad \text{Equation 4}$$

where $\theta_e=\pi/2 * \omega/\omega_o$ and $\theta_o=\pi/2* (\omega/\omega_o)(E_{effo}/E_{effe})^{\frac{1}{2}}$. Equation 3 reduces to:

$$2* \omega* C=Y_{ooa}* \cot [(\pi/2)(E_{effo}/E_{effe})^{\frac{1}{2}}] \qquad \text{Equation 5}$$

Equations 4 and 5 can be solved for the unknowns, with the following result:

$$Z_{ooa}=(2/\pi)*Z_{ooi}[\cot(\pi/2)(E_{effo}/E_{effe})^{\frac{1}{2}}+(\pi/2)(E_{effo}/E_{effe})^{\frac{1}{2}}] \qquad \text{Equation 6}$$

$$2* \omega* C=Y_{ooa}* \cot[(\pi/2)(E_{effo}/E_{effe})^{\frac{1}{2}}] \qquad \text{Equation 7}$$

The use of the equations above has been designed for a microstrip Schiffman phase shifter using lumped element capacitive compensation. The substrate used in the example is gallium arsenide (GaAs), with the h=100 micrometers ($\mu$m), $E_R$=12.9, and t=3.0 $\mu$m.

Table 1 below illustrates the design and performance information for the microstrip Schiffman phase shifter example described, for both uncompensated and capacitively compensated implementations; LineCalc and Touchstone software from EEsof Incorporated, 5601 Lindero Canyon Road, Westlake Village, Calif. were used to generate simulations of the coupled line structures and performance characteristics, respectively:

TABLE 1

| Parameter | Uncompensated | Compensated |
|---|---|---|
| Phase Shift | 90 degrees | 90 degrees |
| Center Frequency | 35 GHz | 35 GHz |
| $Z_{oe}$ | 82.66 ohms | 82.66 ohms |
| $Z_{oo}$ | 30.26 ohms | — |
| $Z_{ooa}$ | — | 30.37 ohms |
| l | 789.30 $\mu$m | 721.0 $\mu$m |
| w | 44.21 $\mu$m | 44.09 $\mu$m |
| s | 16.92 $\mu$m | 17.07 $\mu$m |
| $E_{effe}$ | 8.79 | 8.79 |
| $E_{effo}$ | 6.05 | 6.05 |
| C | — | 0.0205 pF |
| Return Loss | −6.0 dB | −∞ |
| Insertion Loss | −1.0 dB | 0 dB |

Scrutiny of the results indicate that the capacitive compensation provides ideal Schiffman phase shifter performance over an octave band frequency coverage.

Thus, a MMIC differential phase shifter has been described which overcomes specific problems and accomplishes certain advantages relative to prior art methods and mechanisms. The improvements over known technology are significant. Microstrip Schiffman phase shifters typically suffer from poor match because of inhomogeneous dielectric. As a result, odd and even modes excited in the coupled region exhibit different velocities and consequently different wavelengths. Thus, there has also been provided, in accordance with an embodiment of the invention, a MMIC differential phase shifter that fully satisfies the aims and advantages set forth above. While the invention has been described in conjunction with a specific embodiment, many alternatives, modifications, and variations will be apparent to those of ordinary skill in the art in light of the foregoing description. Accordingly, the invention is intended to embrace all such alternatives, modifications, and variations as fall within the spirit and broad scope of the appended claims.

What is claimed is:

1. A microwave monolithic integrated circuit (MMIC) differential phase shifter comprising:

an input microstrip for receiving an input signal;

first and second microstrips separated by a substantially uniform gap, the first and second microstrips for producing a phase shifted signal from the input signal, wherein the first microstrip is coupled at a first end of the first microstrip to the input microstrip, and the first microstrip is coupled at a second end of the first microstrip to an end microstrip, and wherein the second microstrip is coupled at a first end of the second microstrip to the end microstrip; and an output microstrip for producing an output signal from the phase shifted signal, wherein the output microstrip is coupled to the second microstrip at a second end of the second microstrip, the input microstrip and the output microstrip are partially overlapped such as to provide edge-to-edge capacitive coupling, and the first and second microstrips are parallel to each other and perpendicular to both the input microstrip and the output microstrip.

2. A MMIC differential phase shifter as claimed in claim 1, wherein the input microstrip and the output microstrip are capacitively coupled using a interdigitated capacitor.

3. A MMIC differential phase shifter as claimed in claim 1, wherein the input microstrip and the output microstrip are capacitively coupled using a metal-insulator-metal (MIM) capacitor.

4. A MMIC differential phase shifter as claimed in claim 1, wherein one-fourth wavelength of the input signal at a center frequency equals a length measured from a line of symmetry along the center of the input and output microstrips to the second end of the first microstrip and to the first end of the second microstrip.

5. A microwave monolithic integrated circuit (MMIC) Schiffman phase shifter comprising:

an input microstrip for receiving an input signal;

first and second microstrip separated by a substantially uniform gap, the first and second microstrip for producing a phase shifted signal from the input signal, wherein the first microstrip is coupled at a first end of the first microstrip to the input microstrip, and the first microstrip is coupled at a second end of the first microstrip to an end microstrip, and wherein the second microstrip is coupled at a first end of the second microstrip to the end microstrip; and an output microstrip for producing an output signal from the phase shifted signal, wherein the output microstrip is coupled to the second microstrip at a second end of the second microstrip, the input microstrip and the output microstrip are partially overlapped such as to provide edge-to-edge capacitive coupling, and the first and second microstrips are parallel to each other and perpendicular to both the input microstrip and the output microstrip.

6. A MMIC differential phase shifter as claimed in claim 5, wherein the input microstrip and the output microstrip are capacitively coupled using a interdigitated capacitor.

7. A MMIC Schiffman phase shifter as claimed in claim 5, wherein the input microstrip and the output microstrip are capacitively coupled using a metal-insulator-metal (MIM) capacitor.

8. A MMIC differential phase shifter as claimed in claim 5, wherein one-fourth wavelength of the input signal at a center frequency equals a length measured from a line of symmetry along the center of the input and output microstrip to the second end of the first microstrip and to the first end of the second microstrip.

9. A microwave monolithic integrated circuit (MMIC) phase shifter comprising:

an input microstrip;

a U-shaped microstrip comprising first and second parallel portions of the U-shaped microstrip separated by a substantially uniform gap, wherein the input microstrip is coupled substantially perpendicularly to the first parallel portion of the U-shaped microstrip; and an output microstrip coupled substantially perpendicularly to the second parallel portion of the U-shaped microstrip and also partially overlapped to the input microstrip to provide edge-to-edge capacitive coupling wherein the input microstrip receives an input signal including a center frequency, the U-shaped microstrip produces a phase-shifted signal from the input signal, and the output microstrip produces an output signal from the phase-shifted signal, with the output signal exhibiting ideal Schiffman phase shifter performance at the center frequency.

* * * * *

UNITED STATES PATENT AND TRADEMARK OFFICE

CERTIFICATE OF CORRECTION

PATENT NO. : 5,432,487

DATED : July 11, 1995

INVENTOR(S) : Michael Dydyk

It is certified that error appears in the above-indentified patent and that said Letters Patent is hereby corrected as shown below:

Column 6, claim 5, line 5, "microstrip" should be --microstrips--.
Column 6, claim 6, line 23, delete "differential" insert --Schiffman--.
Column 6, claim 8, line 31, delete "differential" insert --Schiffman--; and line 35, "microstrip" should be --microstrips--.
Column 6, claim 9, line 50, "coupling wherein" should be --coupling, wherein--.

Signed and Sealed this

Sixteenth Day of April, 1996

Bruce Lehman

BRUCE LEHMAN

*Commissioner of Patents and Trademarks*

*Attest:*

*Attesting Officer*